US006431407B1

(12) United States Patent
Hogan et al.

(10) Patent No.: US 6,431,407 B1
(45) Date of Patent: Aug. 13, 2002

(54) CONTAINER FILLING DEVICE

(75) Inventors: Jeff W. Hogan, Modesto; Donald R. Oehrlein, Oakdale, both of CA (US)

(73) Assignee: Hogan Mfg., Inc., Escalon, CA (US)

( * ) Notice: Subject to any disclaimer, the term of this patent is extended or adjusted under 35 U.S.C. 154(b) by 0 days.

(21) Appl. No.: 09/695,181

(22) Filed: Oct. 24, 2000

Related U.S. Application Data

(63) Continuation-in-part of application No. 09/152,498, filed on Sep. 9, 1998, now Pat. No. 6,145,709.

(51) Int. Cl.[7] ..... B65B 1/00

(52) U.S. Cl. ..... 222/278; 222/254; 222/367; 222/370; 141/71; 141/236; 141/248; 141/256; 141/313; 141/317

(58) Field of Search ..... 222/144, 254, 222/264, 278, 344, 367, 370; 141/10, 71, 234, 236, 231, 256, 84, 313–317

(56) References Cited

U.S. PATENT DOCUMENTS

| | | | | |
|---|---|---|---|---|
| 53,809 | A | | 4/1866 | Gillett |
| 300,219 | A | | 6/1884 | Cochrane |
| 347,393 | A | | 8/1886 | Smith |
| 367,599 | A | | 8/1887 | Conant |
| 513,700 | A | | 1/1894 | Anderson |
| 707,544 | A | | 8/1902 | Bates |
| 711,144 | A | | 10/1902 | Wright |
| 733,247 | A | | 7/1903 | Mitchell |
| 744,338 | A | | 11/1903 | Hall |
| 1,018,228 | A | | 2/1912 | Appleby et al. |
| 1,110,018 | A | | 9/1914 | Van Schoiack |
| 1,253,948 | A | | 1/1918 | Dugas |
| 1,254,371 | A | | 1/1918 | Smith |
| 1,696,376 | A | * | 12/1928 | Ayars ..... 222/370 |
| 1,765,346 | A | | 6/1930 | Rosenfeld |
| 1,783,423 | A | | 12/1930 | Harper |
| 1,828,167 | A | * | 10/1931 | Ayars ..... 222/370 |
| 1,909,670 | A | | 5/1933 | Evans |
| 2,025,397 | A | | 12/1935 | Montgomery et al. |
| 2,084,711 | A | | 6/1937 | Smith |
| 2,110,687 | A | | 1/1938 | Weinstein |
| 2,141,737 | A | | 12/1938 | Du Bois |
| 2,144,923 | A | | 1/1939 | Kester et al. |
| 2,151,283 | A | | 3/1939 | Stockdale |
| 2,623,671 | A | | 12/1952 | Firestone |
| 3,251,511 | A | * | 5/1966 | Lloyd ..... 222/370 |
| 3,552,346 | A | | 1/1971 | Garden |
| 3,554,406 | A | | 1/1971 | Kleysteuber |
| 3,771,578 | A | | 11/1973 | Huff |
| 3,968,626 | A | | 7/1976 | Hobbs |
| 4,073,410 | A | | 2/1978 | Melcher |
| 4,139,029 | A | | 2/1979 | Geraci |
| 4,240,474 | A | | 12/1980 | Perkins |
| 4,241,769 | A | | 12/1980 | Weisner |
| 4,273,167 | A | | 6/1981 | Stillwell |
| 4,635,829 | A | | 1/1987 | Brittingham, Jr. |
| 4,836,421 | A | | 6/1989 | Miyoshi et al. |
| 5,082,032 | A | | 1/1992 | Crocker |
| 5,094,403 | A | * | 3/1992 | Tschumi ..... 222/370 |
| 5,215,127 | A | | 6/1993 | Bergeron |
| 5,244,019 | A | | 9/1993 | Derby |
| 5,339,597 | A | | 8/1994 | Naka et al. |
| 5,397,085 | A | | 3/1995 | Spagnolo |

(List continued on next page.)

*Primary Examiner*—J. Casimer Jacyna
(74) *Attorney, Agent, or Firm*—Christensen O'Connor Johnson Kindness PLLC

(57) ABSTRACT

An automatic container filler (20) having a frame (22) that supports a hopper (24). A dispensing unit (26) is located at the bottom of the hopper (24) that selectively feeds a fluent material, such as sand, into a plurality of discharge chutes (28). The automatic container filler (20) is designed such that fluent material, such as sand, is fed into the hopper (24). The dispensing unit (26) moves the fluent material from the hopper (24) through the discharge chutes (28) into containers such as sandbags. The dispensing unit (26) deposits a predetermined amount of the fluent material through each of the discharge chutes (28) and into containers in sequential order.

18 Claims, 7 Drawing Sheets

U.S. PATENT DOCUMENTS 5,417,261 A 5/1995 Kanzler et al.
5,425,403 A 6/1995 Hermann
5,437,318 A 8/1995 Kanzler et al.
5,443,102 A 8/1995 Svendsen
5,687,781 A 11/1997 Grizz
5,848,625 A 12/1998 Ebert

* cited by examiner

CONTAINER FILLING DEVICE

This application is a Continuation-In-Part application of U.S. patent application Ser. No. 09/152,498, filed Sep. 9, 1998, now U.S. Pat. No. 6,145,709 the disclosure hereby expressly incorporated by reference.

FIELD OF THE INVENTION

This invention relates to a device for dispensing fluent material into containers and, more particularly, a device for dispensing fill material such as sand into bags or other containers.

BACKGROUND OF THE INVENTION

Frequently, it is desirable to fill bags, boxes, or other containers which have small openings with a large volume of fluent material. Examples of the fluent material include powders, sand, gravel, rock, pebbles, dirt, soil, limestone waste, cement, grain, fertilizer, or other granular or powdery material that is capable of flowing. For example, when a flood occurs, sandbags are typically used to control flooding and/or to shore up saturated earth. Plastic or burlap bags are filled with sand and are arranged to form a waterproof barrier that prevents flooding or movement of the saturated earth.

Filling sandbags is particularly a problem because it generally requires extensive manpower and usually more time than emergency situations allow. Currently, the typical method of filling sandbags is for front-end loader tractors to dump sand in piles at a location where the sandbags will be filled and used. Then, workers typically fill the sandbags manually using shovels either by dumping the sand directly from the shovel into the sandbags or by employing a funnel-like tool. Such a method of filling sandbags is very inefficient. Not only does this method require more than one worker, but it is also excessively slow. Furthermore, spillage frequently occurs due to the sand falling off the shovel and onto the ground, both while transporting the sand from the stockpile and while transferring the sand into the sandbag. These inefficiencies combine to make using shovels to manually fill sandbags with sand an expensive and time-consuming endeavor.

In addition to the above-listed problems, often the area at flood risk is located in a remote area. Large numbers of sandbags need filling and placement in a very short period of time to minimize property damage due to flood waters and movement of saturated earth. Filling sandbags by one person shoveling sand into a sandbag as described above can often not be performed fast enough to produce a sufficient number of filled sandbags.

Recently, a number of companies have developed power-driven sandbag fillers. For example, U.S. Pat. No. 5,417,261 to Kanzler et al. discloses a fluent material dispensing apparatus having a hopper for receiving and holding a fluent material such as sand. The hopper has an open rectangular mouth that converges into multiple individual discharge openings. Each of the discharge openings includes a discharge chute for dispensing the sand. A swing gate is pivotably mounted to each discharge chute and is moveable from an opened to a closed position over the opening of the discharge chute for covering and uncovering the discharge chute to control the discharge of sand from the hopper. A foot pedal is operated to open the swing gate to allow the sand to dispense from the hopper while a worker holds a sandbag underneath the discharge chute. A similar device is disclosed in U.S. Pat. No. 5,437,318, also to Kanzler et al.

A problem with the automatic bag-filling devices of the prior art, such as were disclosed in the Kanzler et al. patents, was that an individual had to hold the bag in place, which could be uncomfortable and could cause strain on the back of the worker. In addition, to fill four bags with the device of Kanzler et al., at least four individuals had to be used, one at each station for simultaneously depressing the foot pedal and holding a bag in place.

There is a need for device that fills containers with sand and other fluent material that incorporates a simple and inexpensive construction and which provides quick and reliable loading of sandbags or other containers. Preferably, such a device would require a minimal number of workers and very little manual labor for those workers so as to produce filled containers.

SUMMARY OF THE INVENTION

The present invention provides a device for filling containers with a fluent material. The device includes a hopper for receiving the fluent material, a plurality of discharge chutes, and a dispensing unit that supplies approximately a predetermined amount of fluent material to the plurality of discharge chutes. Containers at the discharged chutes are filled by the predetermined amount of fluent material.

In accordance with one aspect of the present invention, the fluent material is sand, and the containers are sandbags.

In accordance with another aspect of the present invention, the hopper includes a plurality of openings, and the dispensing unit comprises a plurality of carriers that are configured so that each are first aligned with an opening in the hopper where they are filled with approximately the predetermined amount of fluent material, and second are aligned with a discharge chute so that the carrier empties the predetermined amount into a corresponding discharge chute. Preferably, the carriers are cone shaped.

In accordance with another aspect of the invention, the carriers are located around the circumference of a cylinder. In one embodiment, the carriers are arranged so that their central axes extend radially relative to the cylinder. Preferably, the hopper is located above the cylinder, and the discharge chutes are located below the cylinder so that the carriers are filled by the hopper as they face upward, and empty into the discharge chutes as they face downward.

To permit sequential loading of the containers, one embodiment provides that the carriers are offset circumferentially around the cylinder. Preferably, the number of carriers is at least four, and the carriers are offset substantially 90 degrees circumferentially relative to each other.

The present invention also provides a device for dispensing fluent materials, having a hopper, and first and second units that are removably attachable to the hopper and include discharge chutes and dispensing units as described above.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
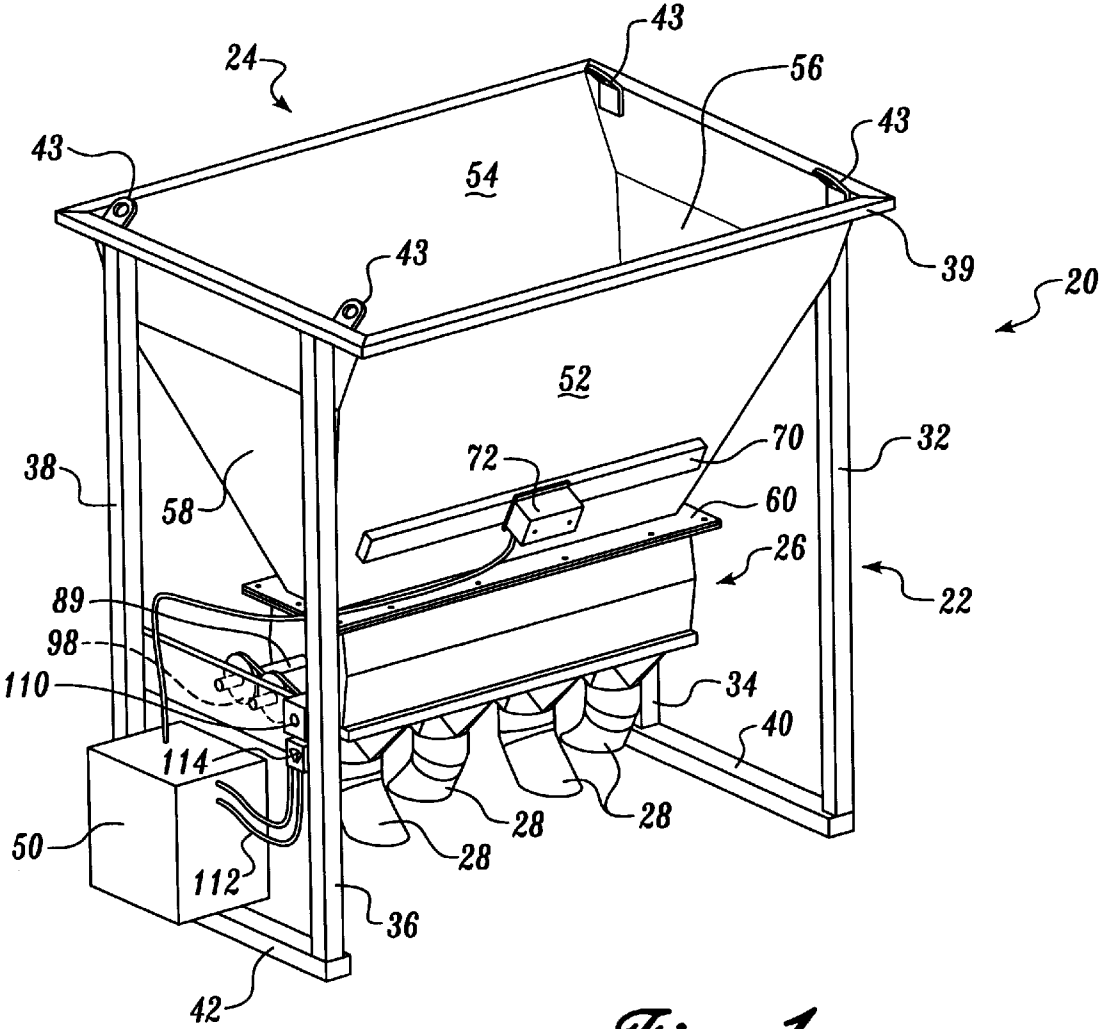
FIG. 1 is a perspective view of an automatic container filler embodying the present invention.

Referring now to the drawing, in which like reference numerals represent like parts throughout the several views, FIG. 1 shows an automatic container filler 20 in accordance with the present invention. The automatic container filler 20 includes a frame 22 that supports a hopper 24. A dispensing unit 26 is located at the bottom of the hopper 24 that selectively feeds a fluent material, such as sand, into a plurality (more than one, but shown in FIG. 1 as four) of discharge chutes 28.

In summary, the automatic container filler 20 is designed such that fluent material, such as sand, is fed into the hopper 24. The dispensing unit 26 moves the fluent material from the hopper 24 to the discharge chutes 28 into containers such as sandbags. In a preferred embodiment such as is shown in FIG. 1, the dispensing unit 26 deposits a predetermined amount of the fluent material through each of the discharge chutes 28 and into containers in sequential order.

The frame 22 for the automatic container filler 20 includes four posts 32, 34, 36, 38 at the comers of the frame that extend from the ground up to a rectangular bracket 39 that provides support for top end of the hopper 24. Cross-braces 40, 42 extend between the front right post 32 and the rear right post 36 and between the front left post 34 and the rear left post 38 and along the bottom of the frame 22.

Four rings 43, such as bent plate lifting eyes, are located at the comers of the rectangular bracket 39. The four rings 43 are used to lift the automatic container filler 20.

The dispensing unit 26 is bolted to the bottom of the hopper 24 and is supported thereby. A hydraulic power system 50, including conventional power sources such as a small-bore engine and a hydraulic system including a hydraulic pump and motor (not shown, but well-known in the art) is attached to the left side of the frame 22 along the bottom. Other power systems can be used for the automatic container filler 20 to perform the functions of the hydraulic power system 50 described herein, and can be adapted by one of skill in the art to meet the requirements of the invention described herein.

Figure 2:
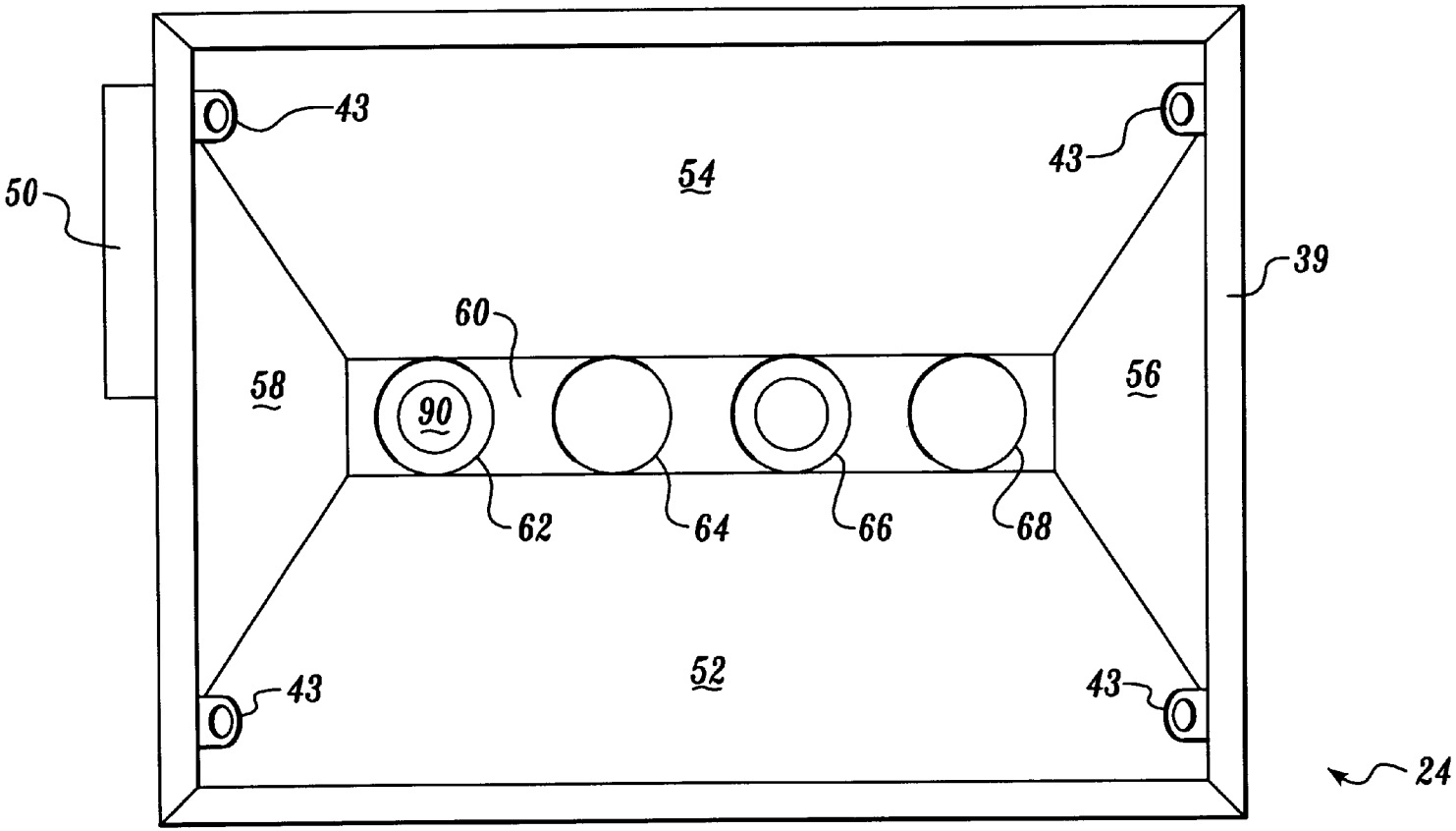
FIG. 2 is a top view of the automatic container filler of FIG. 1.
Figure 3:
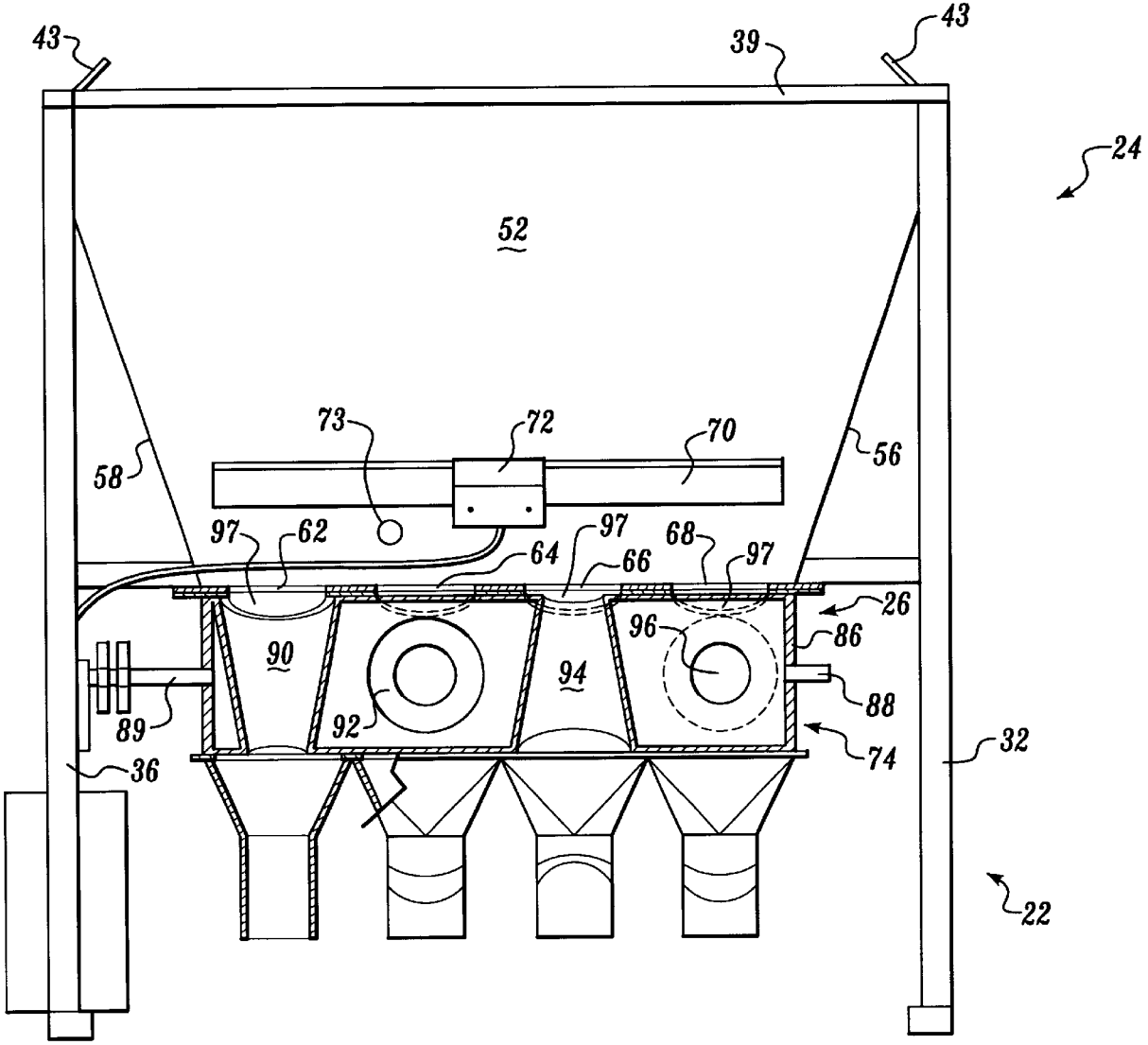
FIG. 3 is a front view of the automatic container filler of FIG. 1, with portions removed for detail.
Figure 4:
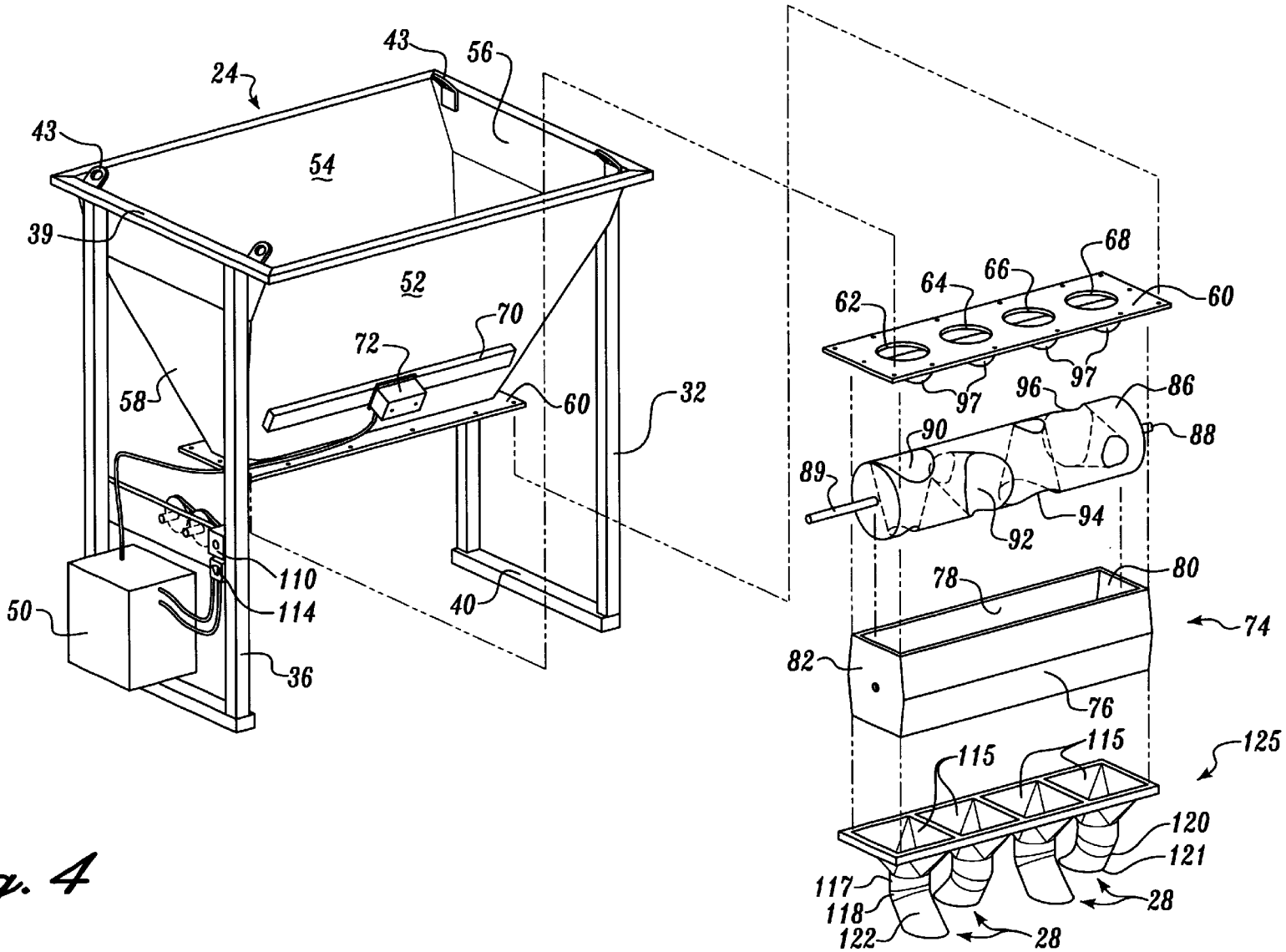
FIG. 4 is an exploded perspective view of the automatic container filler of FIG. 1.

As is best shown by FIG. 4, the hopper 24 includes front and rear walls 52, 54 that converge downward so as to form a "V" shape from the side view. Side walls 56, 58 of the hopper also converge inwardly, but at less slope (FIG. 3). The front wall 52, rear wall 54, and side walls 56, 58 terminate at a rectangular bottom plate 60 (FIG. 2) that is aligned horizontally along the bottom of the hopper 24. The bottom plate 60 includes holes 62, 64, 66, and 68 that are spaced evenly along the length of the bottom plate and are centered along the bottom plate.

In the embodiment of the automatic container filler 20 shown in the drawing, the hopper 24 is 64 inches wide and 80 inches long at the top rectangular bracket 39. The sides of the hopper 24 taper downward so that the bottom panel is 62 inches long. Each of the holes 62, 64, 66, 68 are 9¼ inches in diameter, and are spaced apart from their centers at 14 inches apiece. The front and rear walls 52, 54 of the hopper 24 extend downward and inward to adjacent the front and rear edges of the holes 62, 64, 66, and 68. The hopper 24 is 48 inches tall and is preferably formed of a steel weldment. It is to be understood that the hopper 24 could be made of a variety of different materials and could be dimensioned in a number of different manners so as to fit an appropriate application.

A metal vibrator plate 70 (best shown in FIG. 3) in the shape of a channel extends lengthwise along a bottom portion of the front wall 52 of the hopper 24. The metal vibrator plate 70 is preferably steel and is welded in place, and is preferably of a length that extends substantially the width of the front wall 52. In the embodiment shown, the metal vibrator plate 70 is approximately 3 inches wide by 54 inches long, and is attached so that its center line is spaced approximately 12 inches from the rectangular bottom plate 60.

A vibrator 72 is attached to the metal vibrator plate 70 at approximately the metal vibrator plate's center. In the embodiment shown, the vibrator 72 is a hydraulic vibrator, for example one made by Cougar Industries, Inc., which is capable of 9000 vibrations per second, at 3.15 gallons per minute. The metal vibrator plate 70 distributes vibrations from the vibrator 72 along the width of the front wall 52 so that sand or other fluent material within the hopper 24 is evenly shaken to the rectangular bottom plate 60 and the holes 62, 64, 66, 68 of the hopper 24, and collapses bridged fluent material within the hopper. The vibrator 72 is fed pressurized hydraulic fluid from the hydraulic power system 50.

The dispenser unit 26 is best shown in FIG. 4. The dispenser unit 26 includes a rectangular enclosure 74 having an open bottom and an open top, and front, rear, and side walls 76, 78, 80, and 82. The tops of the front, rear and side walls 76, 78, 80, and 82 are flanged so that they can be bolted to the bottom plate 60 (shown twice in FIG. 4 for clarification) of the hopper 24. The flanges (not shown) provide an easy and convenient attachment of the dispensing unit 26 to the hopper 24. The frame 22 could also be extended to support the connection of the dispensing unit 26 and the hopper, if further support is desired.

A dispenser 84 is mounted for rotation within the rectangular enclosure 74. The dispenser 84 includes a cylinder 86. As can be seen in FIG. 3, the cylinder 86 includes end shafts 88, 89 that extend axially out of the ends of the cylinder 86 and into holes in the side walls 80, 82 of the rectangular enclosure 74. The end shafts 88, 89 extend out of the side walls 80, 82 of the rectangular enclosure 74 and are freely rotatable within bearings (not shown, but well-known in the art).

A series of carrier vessels 90, 92, 94, 96 (FIG. 4) are located within the cylinder 86, and are oriented so that their central axes extend radially relative to the cylinder. The carrier vessels 90, 92, 94, 96 are spaced along the length of the cylinder 86, and are preferably spaced an amount that is substantially equal to the spacing of the holes 62, 64, 66, 68 in the rectangular bottom plate 60 of the hopper 24. The carrier vessels 90, 92, 94, 96 are preferably cone-shaped such that the walls of each of the carrier vessels taper downward so as to form a small bottom end and a larger top opening. The bottom end of the carrier vessels 90, 92, 94, 96 in the embodiment shown is 5¾ inches in diameter, and the top end is 10.85 inches in diameter. The conical shape of the carrier vessels 90, 92, 94, 96 permits sand or other fluent material to be easily poured into and then poured out of the carrier vessels, as is described in detail below.

The carrier vessels 90, 92, 94, 96 preferably have openings that are offset circumferentially 90 degrees around the circumference of the cylinder 86 relative to one another. Thus, in the embodiment shown, an opening of the first carrier vessel 90 (in FIG. 3, facing upward) is oriented exactly opposite (i.e., 180 degrees) to an opening of the third carrier vessel 94 (in FIG. 3, facing downward). The function of this carrier vessel arrangement is described in detail below.

Figure 5:
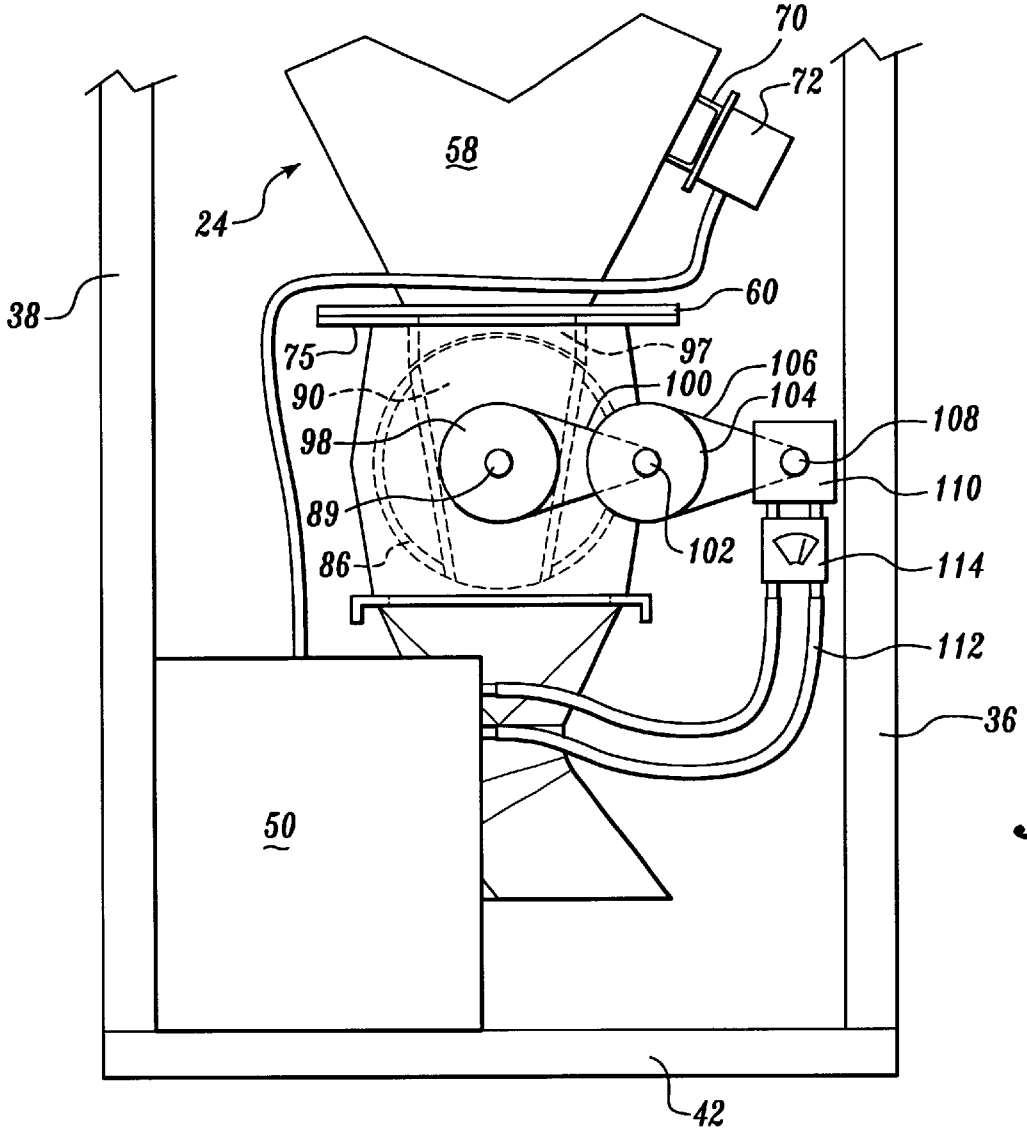
FIG. 5 is a schematic end view of the automatic container filler of FIG. 1.

At the bottom of the bottom plate 60 of the hopper 24 and extending from each of the holes 62, 64, 66, 68 are spouts 97 (best shown in phantom in FIG. 5). Each spout 97 preferably has a diameter that substantially matches the diameter of the respective hole 62, 64, 66, 68 , and includes a bottom portion that is radiused so as to fit snugly against the top of the cylinder 86 of the dispenser 84. The function of the spouts 97 is described in detail below.

As can be seen in FIG. 5, a large sprocket 98 is located on the end shaft 88 of the dispenser 84. A chain 100 extends around and over the large sprocket and over a small sprocket 102 that is rotatably mounted on a power plate 102 attached to the frame 22 between the posts 36, 38. A second large sprocket 104 is fixed for rotation on the power plate with the small sprocket 102. A second chain 106 extends over the large sprocket 104 and a second small sprocket 108. The second small sprocket 108 is rotatably mounted on the side wall 80 of the rectangular enclosure 74 and is attached to a hydraulic motor 110. The hydraulic motor 110 is fed hydraulic fluid by the hydraulic power system 50. A hydraulic line 112 extends to the hydraulic motor 110 for supplying pressurized hydraulic fluid to the hydraulic motor. A variably adjustable valve 114 is located in the hydraulic line 112 for adjusting the flow of hydraulic fluid through the hydraulic line 112 to the hydraulic motor 110. An emergency button 73 (FIG. 3) can be provided for immediate shut-off of the hydraulic power system 50 or the hydraulic motor 110.

The discharge chutes 28 are best shown in FIG. 4. The discharge chutes 28 include a funnel-shaped receiving bay 115 aligned concentrically with the respective carrier vessel 90, 92, 94, 96 when the carrier vessel is arranged vertically. The funnel-shaped receiving bay 115 feeds to a curvilinear cylinder 116. The curvilinear cylinder 116 has an upper input opening 117, a curvilinear side wall 118, and a lower output opening 119. The upper input opening 117 has a similar size to, and is attached to, the lower end of the funnel-shaped receiving bay 115. The curvilinear side wall 118 has a rear surface 120 that includes an inwardly projecting portion 121 and a front surface 122 that includes an outwardly projecting portion 124 that extends in the same direction as the inwardly projecting portion 121. The outwardly projecting portion 124 extends outwardly and downwardly at a predetermined angle relative to the vertical, and has a predetermined length. The bottom edges of the inwardly projecting portion 121 and the outwardly projecting portion 124 define the discharge upper input opening 117. The predetermined angle, the length, and the height are selected so that an empty sandbag can be suspended from the projecting portion 121, and the bag gradually slides downward as it is filled with sand, as described below.

The parts of the dispensing unit 26 and the discharge chutes 28 described herein are preferably made of steel weldments. However, a person of ordinary skill in the art could adapt different materials in the construction of these items.

The operation of the automatic container filler 20 will now be described. The automatic container filler 20, because of its solid steel construction and reasonable size, can be transported to a location for the filling of fluent material, such as sand. The automatic container filler 20 can be lifted by the rings 43 or by other convenient methods.

In the case of sand, the sand is loaded into the hopper 24 by a backhoe or other conventional means. The vibrator 72 is turned on so as to cause the sand to settle to the bottom of the hopper 24.

The variably adjustable valve 114 is adjusted so as to cause the sprockets and chains 98–108 to rotate, causing the end shafts 88, 89 and the cylinder 86 of the dispenser 84 to rotate. The large and small sprockets 98, 102, 104, 108 act as gear reducer to the hydraulic motor 110, and thus the cylinder 86 can be turned at a slow rate and its speed is easily variably adjusted. During rotation, the carrier vessels 90, 92, 94, 96 are, in successive order, brought into alignment with a respective hole 62, 64, 66, 68 and spout 97. Because the upper opening of the respective carrier vessel 90, 92, 94, 96 is larger than the respective hole 62, the carrier vessel is exposed to the holes over a substantial period of rotation of the cylinder 86.

As rotation of the cylinder begins, the first carrier vessel 90 is brought into alignment with the first hole 62 and corresponding spout 97. During this rotation, the rear edge of the spout 97 first comes into contact with the front edge of the upper opening of the carrier vessel 90. Sand enters the carrier vessel 90 through the spout 97 and begins to fill the carrier vessel. Continued rotation of the cylinder 86 causes the center of the spout 97 to come into alignment with the center of the carrier vessel 90. By the time the spout has reached this point over the carrier vessel 90, the carrier vessel 90 is substantially filled with sand. The sand already in the carrier vessel 90 prevents further emptying of sand from the hopper through the spout 97.

Further rotation of the cylinder 86 causes the leading edge of the spout 97 to come into contact with the circumference of the cylinder just outside the carrier vessel 90. The toleranced fit of the spout 97 with the outer surface of the cylinder 86 prevents substantial loss of sand through the juncture of the spout 97 and the cylinder 86. As the cylinder 86 rotates further, the spout 97 is in complete contact with the cylinder, and the filled carrier vessel 90 begins rotation downward so as to dump sand into the funnel-shaped receiving bay.

Although the toleranced fit of the spout 97 with the cylinder 86 prevents the substantial loss of sand, there is naturally some loss of sand during movement of the spout 97 across the opening of the carrier vessel 90. However, any sand lost during this movement falls into the funnel-shaped receiving bay 115, and is minimized due to the size of the opening of the carrier vessel 90 being larger than the spout, which permits loose sand to fall from the outer perimeters of the spout into the outer edges of the opening of the carrier vessel.

Preferably, the variably adjustable valve 114 is properly adjusted so that the hydraulic motor 110 turns the cylinder 86 at a speed so that sand completely fills the carrier vessel 90 while the carrier vessel is exposed to the spout 97. As stated above, after the opening of the carrier vessel 90 passes beyond the hole 62, the contact of the spout 97 with the outer walls of the cylinder 86 prevents further flow of sand through the hole 62. Continued rotation of the cylinder 86 causes the next carrier vessel 92 to come into alignment with the next hole 64, and so forth, so that one carrier vessel is being filled during almost all points of rotation of the cylinder 86.

As the carrier vessels 90, 92, 94, 96 that are full of sand are inverted, or turned upside down, the contents of the carrier vessel empty into the funnel-shaped receiving bay 115 and then into the discharge chute 28.

Prior to beginning operation of the dispenser unit 26, flexible bags (not shown, but well-known in the art), such as sandbags, are placed over each of the curvilinear cylinders 116 of the discharge chutes 28 so that one comer of the bottom of the bag is positioned adjacent to the tip end 126 of the outwardly projecting portion 124. The upper open-end portion of the bag is bunched together around the upper portion of the curvilinear cylinder 116. The length and the predetermined angle of the outwardly projecting portion 124 are selected so that friction between the bag and the outwardly projecting portion will keep the bag suspended above the ground, and held open, without sliding off the curvilinear cylinder 116.

As sand is deposited by the carrier vessels 90, 92, 94, 96 through the funnel-shaped receiving bay 115 and into the curvilinear cylinder 116, the sand is compressed by the upper portion of the curvilinear cylinder and is deposited into the bottom of the suspended bag by the force of gravity. As the bag fills with sand, the increasing weight of the sand in the bag causes the bag to gradually slide down the curvilinear cylinder until the bottom of the bag rests on the ground. Both before and after the bag bottom reaches the ground, the bag's upper portion is suspended and held open by the curvilinear cylinder 116 before receiving more sand. After the bag has been filled by the corresponding carrier cup 90, 92, 94, or 96, the upper portion of the bag is slid off the curvilinear cylinder 116 by a worker, leaving the bag resting substantially upright on the ground. The filled bag is slid or carried out of the way, and another bag is slipped over the curvilinear cylinder so that the respective carrier vessel 90, 92, 94, or 96 can fill the bag during the next rotation of the cylinder 86.

Because the carrier vessels 90, 92, 94, 96 are offset 90 degrees relative to one another, bags on the discharge chutes 28 are not filled at the same time. Thus, the speed of the hydraulic motor 110 can be set by the variably adjustable valve 114 so that items can be deposited into bags or other containers at a speed so that a single worker, two workers, three workers, or four workers can move filled containers away from the discharge chutes 28 as they are filled. A new bag is then placed on the discharge chute 28 by a worker and, if the speed of rotation of the cylinder 86 is slow enough, the same worker can move onward to another discharge chute 28 to remove another filled bag and then place an empty bag over the discharge chute. More workers can be used to remove and replace bags when the cylinder is rotating at a faster pace. The fact that the carrier vessels 90, 92, 94, 96 dump sand into a particular discharge chute 28 only once upon a 360 degree rotation of the cylinder 86 should permit a worker or workers enough time to remove a filled bag and replace the filled bag with an empty bag.

As has been described above, it is to be understood that containers other than bags can be used at each of the discharge chutes 28. The discharge chutes 28 can also be shaped or arranged in any efficient manner so that a fluent material can be deposited form the dispensing unit 26 into the containers. For example, in the embodiment shown in the drawing, the discharge chutes are alternatingly directed to opposite sides of the frame 22. In an alternate embodiment, the discharge chutes 28 could all extend out of one side of the frame 22. In addition, fluent material other than sand can be dispensed into the containers. In the embodiment shown in FIG. 4, the discharge chutes 28 are all contained together as one discharge unit 125 that is bolted onto the bottom of the dispensing unit 26. The discharge unit 125 could alternatively lead to one discharge chute 28, or could be replaced with a discharge unit having different sizes or numbers of discharge chutes 28.

Figure 6:
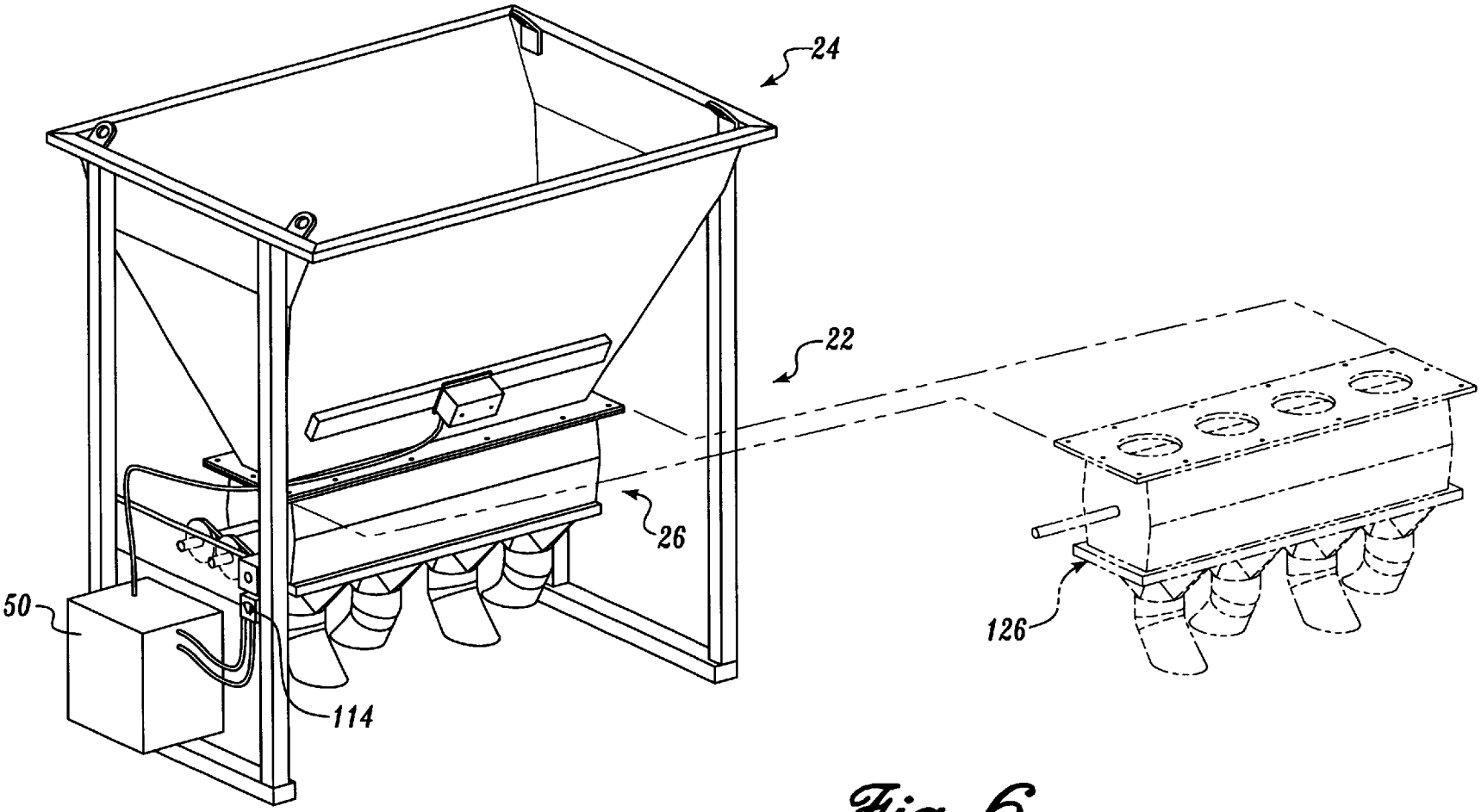
FIG. 6 is a perspective view of the automatic container filler of FIG. 1, with a replacement dispensing unit shown in phantom.

The dispensing unit 26 is bolted to the bottom of the hopper 24 at the bottom plate 60. The dispensing unit 26, as is shown in FIG. 2, can be unbolted from the triangular supports 44, 46 and the hopper 24 so that the dispensing unit can be cleaned, or even replaced with a different dispensing unit 126 (FIG. 6). The second dispensing unit 126 can have different sized carrier vessels and/or discharge chutes so that a different fluent material can be dispensed by the automatic container filler 20, or the same fluent material could be dispensed by different sized carrier vessels into different sized containers.

The construction of the dispensing unit 26 permits substantially the same amount of sand or other fluent material to be deposited into a plurality of sequential sandbags or other containers. Because the carrier vessels 90, 92, 94, 96 hold substantially the same amount of fluent material upon each rotation, and substantially all of that fluent material is dumped into the discharge chute 28 upon rotation of the cylinder 86, the amount of fluent material contained within each bag ends up being substantially the same. It is possible that the second dispensing unit 126 could include a plurality of carrier vessels having a different size than the carrier vessels 90, 92, 94, 96 of the first dispenser unit 26. In this manner, the second dispensing unit 126 could be used with smaller or larger sandbags or other containers. In addition, the carrier vessels on one dispensing unit could be of different sizes so that different sized containers could be filled at the different discharge chutes 28.

Figure 7:
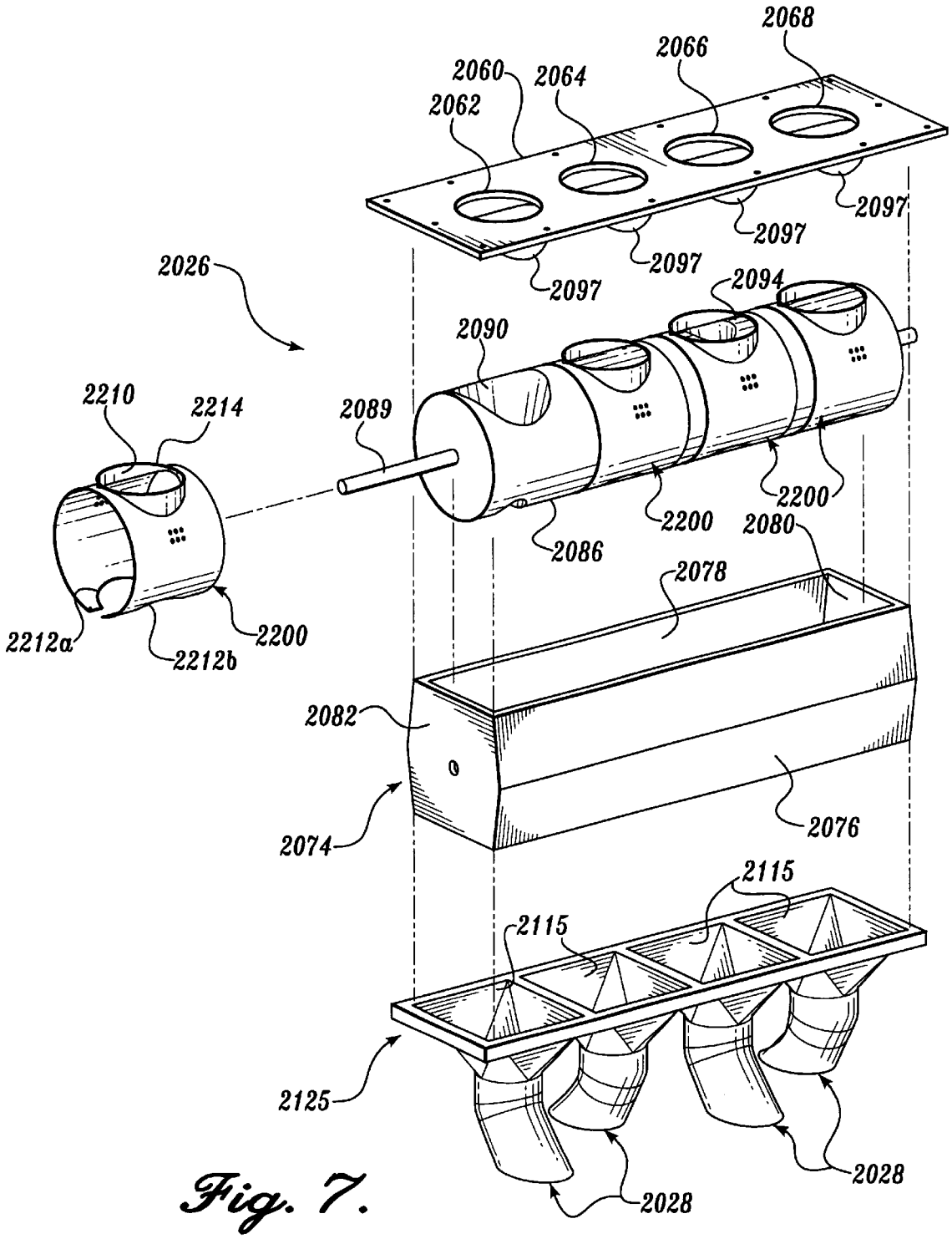
FIG. 7 is an exploded view of an automatic container filler formed in accordance with another embodiment of the present invention and showing a plurality of collars for the automatic container filler.

Referring now to FIG. 7, an alternate embodiment of the automatic container filler formed in accordance with the present invention will now be described in greater detail. The automatic container filler of FIG. 7 is substantially identical in materials and operation for the preferred embodiment described above with the following exception.

The dispensing unit 2026 includes at least one dispenser boot 2200 selectively disposed on the cylinder 2086. The dispenser boot 2200 may be used to minimize the loss of sand during movement through spout 2097. Although use of the dispenser boot 2200 is preferred for dry fluent material, such as sand, such a boot is also suitable for use with both wet and dry fluent material. Further, although four dispenser boots are illustrated as attached to the dispensing unit, a dispensing unit having a greater or fewer number of dispensing boots is also within the scope of the invention.

Each dispenser boot 2200 may be made from any material suitable to allow the cylinder 2086 to rotate inside the dispenser boot 2200 without significant wear to either component. As a non-limiting example, the dispenser boot 2200 is suitably formed from abrasive rubber. The dispenser boot 2200 is suitably formed from a flat piece of material enfolded over the cylinder 2086 and selectively bound in place by a well known fastener (not shown), such as an elastic cable. The fastener extends diagonally between reinforced holes (not shown) located in opposite sides of the dispenser boot 2200.

Alternatively, the dispenser boot 2200 may be in the form of a continuous tubular member installed over the cylinder 2086 from either end of the cylinder 2086 and then secured in place. The dispenser boot 2200 is preferably bound to the discharge chute to limit movement of the dispenser boot 2200 as the cylinder 2086 rotates. However, the dispenser boot 2200 may be bound in anyway so as to limit movement as the cylinder 2086 rotates. Although it is preferred that the cylinder rotate inside the dispenser boot, it should be apparent that other configurations, such as a dispenser boot and cylinder that rotate together, are also within the scope of the present invention.

Each dispenser boot 2200 is formed such that it includes a centrally located fill opening 2210 and a pair of cutouts 2212*a* and 2212*b* formed in opposite ends of the sheet of pliable material. Suitably, the cutouts 2212*a* and 2212*b* are semi-circles, such that when the dispenser boot 2200 is selectively fastened around the cylinder 2086, the cutouts 2212*a* and 2212*b* are joined in an opposed manner to form a discharge opening.

Each dispenser boot 2200 includes a collar 2214 extending upwardly from the central opening 2210. When the dispenser boot 2200 is attached to the cylinder 2086, the collar 2214 aligns with one of the carrier vessels 2090–2096. As a result of this alignment, each collar 2214 forms a seal with the corresponding spout 2097 of the hopper plate 2060.

In operation, as the cylinder 2086 rotates inside the dispenser boot 2200, the opening of a carrier vessel 2090, 2092, 2094, 2096 comes in alignment with the fill opening 2210 the dispenser boot 2200. During this alignment, fluent material moves through the spout 2097, through the fill opening 2210 and into a carrier vessel. As the cylinder 2086 continues to rotate, the opening of the carrier vessel is sealed against the dispenser boot 2200. The tolerance between the dispenser boot 2200 and the cylinder 2086 is minimized to reduce the loss of fluent material passing through the fill opening 2200 and escaping around the cylinder 2086 which would eventually cause loss into the receiving bay 2115.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A device for filling containers with a fluent material, the device comprising:

a hopper for receiving the fluent material;

a dispensing unit removably attachable to the hopper;

a discharge unit coupled to the dispensing unit and having a plurality of discharge chutes;

a dispenser rotatably disposed within the dispensing unit, the dispenser having a plurality of carriers sized and adapted to intermittently supply by gravity a predetermined amount of fluent material to the discharge unit whereby containers at the discharge unit are sequentially filled by the predetermined amount of fluent material; and at least one dispensing boot selectively disposed within the dispensing unit, wherein the dispenser is rotatably disposed within the at least one dispensing boot.

2. The device of claim 1, wherein the at least one dispensing boot comprising sealing means for substantially sealing fluent material passing through a predetermined portion of the hopper.

3. The device of claim 1, wherein the at least one dispensing boot comprising a collar formed with the dispensing boot.

4. The device of claim 3, wherein the collar forms a seal between the hopper and the dispensing unit to substantially seal flow of fluent material passing therethrough.

5. The device of claim 1, wherein the hopper includes a plurality of openings, and the dispensing unit comprises a plurality of carriers that are configured so that each are first aligned with an opening in the hopper where they are filled with approximately the predetermined amount of fluent material, and second are aligned with a discharge chute so that the carrier empties the predetermined amount into a corresponding discharge chute.

6. The device of claim 5, further comprising a plurality of dispensing boots, each of the plurality of dispensing boots having a first and a second opening, the first opening being adapted to allow each one of the plurality of carriers to be filled with the predetermined amount of fluent material, the second opening being adapted to allow the plurality of carriers to empty the predetermined amount of fluent material into the corresponding discharge chute.

7. The device in claim 6, wherein the carriers are located around the circumference of a cylinder and the dispensing boots encircle the cylinder.

8. A device for filling containers with a fluent material, the device comprising:

a hopper for receiving the fluent material;

a dispensing unit removably attachable to the hopper;

a discharge unit coupled to the dispensing unit and having a plurality of discharge chutes;

a dispenser rotatably disposed within the dispensing unit, the dispenser having a plurality of carriers sized and adapted to intermittently supply by gravity a predetermined amount of fluent material to the discharge unit whereby containers at the discharge unit are sequentially filled by the predetermined amount of fluent material; and means for providing a seal between the hopper and the dispensing unit to provide a sealed passage therebetween, wherein the dispenser is rotatably disposed within the means for providing a seal between the hopper and the dispensing unit.

9. The device of claim 8, wherein the fluent material is sand, and the containers are sandbags.

10. The device of claim 8, wherein the hopper includes a plurality of openings, and the dispensing unit comprises a plurality of carriers that are configured so that each are first aligned with an opening in the hopper where they are filled with approximately the predetermined amount of fluent material, and second are aligned with a discharge chute so that the carrier empties the predetermined amount into a corresponding discharge chute.

11. The device of claim 10, further comprising a plurality of means for providing a seal, the means for providing a seal having a first and a second opening, the first opening is adapted to allow the carrier to be filled with the predetermined amount of fluent material, the second opening being adapted to allow the carrier to empty the predetermined amount of fluent material into the corresponding discharge chute.

12. The device in claim 11, wherein the carriers are located around the circumference of a cylinder and the means for providing a seal encircling at least a portion of the cylinder.

13. An improved device for filling containers with a fluent material in which a hopper for receiving fluent material is attached to a dispensing unit having a plurality of carriers sized and adapted to intermittently supply by gravity a predetermined amount of fluent material to a discharge unit whereby containers at the discharge unit are sequentially filled by a predetermined amount of fluent material, wherein the improvement comprises:

a dispenser boot disposed within the dispensing unit and a dispenser rotatably disposed within the dispenser boot, the dispenser boot adapted to substantially seal a predetermined portion of the dispensing unit and maintain the predetermined amount of fluent material supplied to the discharge unit as the dispenser rotates within the dispenser boot.

14. The improvement of claim 13, wherein the dispenser boot is selectively securable to the dispensing unit.

15. The improvement of claim 13, wherein the dispenser boot further comprising a collar formed therewith, wherein the collar forms a seal with a portion of the hopper.

16. The improvement of claim 13, further comprising a plurality of dispenser boots disposed within the dispensing unit to substantially seal a predetermined portion of the dispensing unit.

17. A device for filling containers with a fluent material, the device comprising:

a hopper for receiving the fluent material;

a dispensing unit removably attachable to the hopper;

a discharge unit coupled to the dispensing unit and having a plurality of dischagre chutes;

a dispenser rotatably disposed within the dispensing unit, the dispenser having a plurality of carriers sized and adapted to intermittently supply by gravity a predetermined amount of fluent material to the discharge unit whereby containers at the discharge unit are sequentially filled by the predetermined amount of fluent material;

at least one dispensing boot selectively disposed within the dispensing unit, wherein the hopper includes a plurality of openings, and the dispensing unit comprises a plurality of carriers that are configured so that each are first aligned with an opening in the hopper where they are filled with approximately the predetermined amount of fluent material, and second are aligned with a discharge chute so that the carrier empties the predetermined amount into a corresponding discharge chute; and a plurality of dispensing boots, each of the plurality of dispensing boots having a first and a second opening, the first opening being adapted to allow each one of the plurality of carriers to be filled with the predetermined amount of fluent material, the second opening being adapted to allow the plurality of carriers to empty the predetermined amount of fluent material into the corresponding discharge chute.

18. A device for filling containers with a fluent material, the device comprising:

a hopper for receiving the fluent material;

a dispensing unit removably attachable to the hopper;

a discharge unit coupled to the dispensing unit and having a plurality of discharge chutes;

a dispenser rotatably disposed within the dispensing unit, the dispenser having a plurality of carriers sized and adapted to intermittently supply by gravity a predetermined amount of fluent material to the discharge unit whereby containers at the discharge unit are sequentially filled by the predetermined amount of fluent material; and means for providing a seal between the hopper and the dispensing unit to provide a sealed passage therebetween, wherein the fluent material is sand, and the containers are sandbags.

* * * * *